US008408174B2

(12) United States Patent
Schnell

(10) Patent No.: US 8,408,174 B2
(45) Date of Patent: Apr. 2, 2013

(54) ROCKER ARM

(75) Inventor: Oliver Schnell, Veitsbronn (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 161 days.

(21) Appl. No.: 13/102,363

(22) Filed: May 6, 2011

(65) Prior Publication Data

US 2011/0271923 A1 Nov. 10, 2011

(30) Foreign Application Priority Data

May 6, 2010 (DE) ..... 10 2010 019 532

(51) Int. Cl.
*F01M 1/06* (2006.01)
*F01L 1/18* (2006.01)
*G05G 1/00* (2008.01)

(52) U.S. Cl. ..... 123/90.36; 123/90.33; 123/90.39; 123/90.46; 74/559

(58) Field of Classification Search ..... 123/90.46, 123/90.36, 90.39, 90.33, 321; 74/559
See application file for complete search history.

(56) References Cited

U.S. PATENT DOCUMENTS 2,051,313 A * 8/1936 Olenick ..... 123/90.39
2,522,326 A * 9/1950 Winter, Jr. ..... 74/519
2,650,579 A * 9/1953 Bernight ..... 123/90.37
3,410,366 A * 11/1968 Winter, Jr. ..... 184/6.9
3,502,058 A * 3/1970 Thompson ..... 123/90.34
5,325,825 A * 7/1994 Schmidt et al. ..... 123/90.39
5,588,413 A * 12/1996 Stone et al. ..... 123/508
5,623,899 A * 4/1997 Wolf et al. ..... 123/90.36
5,632,237 A * 5/1997 Cornell et al. ..... 123/90.46
6,138,624 A * 10/2000 Wolck et al. ..... 123/90.39

FOREIGN PATENT DOCUMENTS

DE 1 301 1751 416 B 8/1969
DE 1 751 416 B 7/1971
DE 196 29 203 A1 1/1998
DE 197 18 794 A1 11/1998

* cited by examiner

*Primary Examiner* — Thomas Denion
*Assistant Examiner* — Deming Wan
(74) *Attorney, Agent, or Firm* — Lucas & Mercanti, LLP

(57) ABSTRACT

A rocker arm for a tappet pushrod valve train, which has a contact surface for a gas exchange valve on an underside at one end and a first bore in which a hydraulic lash adjusting element is arranged at another end. A second bore extends transverse through the rocker arm, between the ends. From the second bore, a passage leads to the first bore. A venting passage extends from a bottom of the bore at the another end and has an outlet aligned with the primary passage. A secondary passage branches from the venting passage and has an opening that extends to an upper side of the rocker arm and is situated in a longitudinal channel. The channel extends along the upper side and into a region on the one end. From the region, the hydraulic medium can be routed through an end passage to the contact surface.

10 Claims, 2 Drawing Sheets

ROCKER ARM

CROSS-REFERENCE TO RELATED APPLICATION

This application claims the priority of DE 10 2010 019 065.9 filed May 6, 2010, which is incorporated by reference herein.

FIELD OF THE INVENTION

The invention concerns a rocker arm, particularly for a tappet pushrod valve train.

BACKGROUND OF THE INVENTION

FIG. 1 of DE 196 29 203 A1 discloses a rocker arm comprising a lash adjusting element in a bore on its underside, which lash adjusting element can be supplied through a longitudinally extending primary passage with hydraulic medium from the transverse bore of the rocker arm. Air accumulated in an undesired manner in the lash adjusting element or its surroundings can be led to the outside through a venting passage. In the course of this, a slight quantity of hydraulic medium also escapes through the venting passage to the upper side of the rocker arm and spreads over this finally in an uncontrolled manner.

A lubrication of a contact surface of the rocker arm on the other end, not disclosed on the right in the drawing, on the underside is effected only through an oil mist or through a separate injection bore which starts from the transverse bore. A supply of lubricant to the injection bore is affected at the same time as the supply to the primary passage from the rocker arm axle. In this case, the latter cannot comprise a circumferential groove for taking off the hydraulic medium because only a spot injection for avoiding loss of hydraulic medium is desired. Therefore, as a rule, this axle comprises only a segmental groove and thus has to be installed in a correct orientation which leads to an increase of the total costs of the valve train.

Reference is further made to DE 197 18 794 A1, DE 1 301 823 and DE 1 751 416.

SUMMARY OF THE INVENTION

The object of the invention is to provide a rocker arm of the pre-cited type without the aforesaid drawbacks. In particular, the rocker arm should be configured so that a controlled and economical lubrication of its contact surface on the another end can be realized through simple measures.

The invention is directed to a rocker arm for a tappet pushrod valve train comprising a longitudinal body having a first end, a second end, an upper surface and a lower surface. A contact surface for a gas exchange valve is formed on the lower surface near the first end. A first bore is formed in the lower surface, adjacent to the second end. The rocker also includes a hydraulic lash adjusting element having a support for a tappet pushrod. A second bore is formed in the body, which allows for pivotal mounting of the rocker arm on an axle, extending transversely between the first end and the second end. A channel extends substantially along the upper surface to an end passage at the first end. A primary passage for hydraulic medium extends in the housing between the first bore and the second bore. A venting passage, which is in line with the primary passage, extends from the first bore to an outlet of the venting passage. A secondary passage, which branches off from the venting passage, extendS outwardly from the first bore to an opening in an upper side, allowing the hydraulic medium to flow along the long channel in the upper body toward the first end of the body such that the hydraulic medium can be directed from the end passage to the contact surface.

Specifically, the object is achieved in that hydraulic medium can be routed along the longitudinal channel, which extends along the upper side and into a region on the first end, through an end passage to the contact surface.

According to a first particularly preferred embodiment of the invention, the opening of the secondary passage is positioned so that, as viewed in direction of gravity during a pivoting operation of the rocker arm, the opening of the secondary passage is situated at a lower level, or at least intermittently at a lower level, than the outlet of the venting passage.

In this way, a rocker arm is provided, for example for a valve train of a large truck engine, in which the aforesaid drawbacks are eliminated. The throttled quantity of hydraulic medium carried along anyhow in the venting passage is guided in a controlled manner over the upper side of the rocker arm from the another end to the one end and is utilized there for a sparingly dosed lubrication of the contact surface (in the present case, with the gas exchange valve).

All that is required therefore is to branch off a secondary passage from the venting passage, which secondary passage is made, for example, by boring same as the venting passage followed by the primary passage (as seen in boring direction).

It is understood that these measures can also be implemented on levers in which the lash adjusting element contacts the gas exchange valve, and a roller or a pushrod is applied to the opposite side of the lever. These measures can likewise be used with other types of levers such as oscillating arms etc.

Due to the fact that the opening of the secondary passage is situated geodetically lower than the outlet of the venting passage, it is guaranteed that the throttled flow of hydraulic medium is guided in a controlled manner on the upper side of the rocker arm and does not flow off on the another end.

The end passage on the one end of the rocker arm for conveying the hydraulic medium to the contact surface can indeed be configured as a channel extending in the outer periphery of the rocker arm. It is, however, preferred not to provide separate channels or the like on the one end of the rocker arm, so that, in simple words, the hydraulic medium flows off on the outer periphery of the rocker arm on the one end to the contact surface. Alternatively or in addition, for this purpose, a through-bore can be configured from the upper side to the underside on the one end, which bore starts on the upper side from the longitudinal channel.

For a better separation of the opening of the secondary passage from the outlet of the venting passage on the another end, it is proposed to arrange these elements in a roof-shaped elevation projecting from the upper side. As already set forth, what is important is that, during a pivoting movement of the rocker arm, the opening of the secondary passage, as viewed in gravity direction, is situated at least partially or at least predominantly at a lower level than the outlet of the venting passage and that the secondary passage is directed on the upper side of the rocker arm such that the rocker arm extends at an inclination towards the one end.

The axle on which the rocker arm is mounted comprises only a simple circumferential groove in the region of the transverse bore of the rocker arm and therefore does not have to be mounted in any particular direction. Besides this, the scope of protection of the invention also includes a structural group comprising a rocker arm and an axle. The axle may also be replaced with a bearing pedestal or the like.

The bore for the lash adjusting element in the underside of the rocker arm may be configured as a pocket bore and a spacing disk can bear against the bottom of this bore. This disk enables a throttled escape of air/hydraulic medium over its outer periphery (see also DE 196 29 203 A1) and prevents a "digging-in" of the stationary housing of the lash adjusting element into the bottom of the bore (aluminum rocker arm). Alternatively, the bore may also be configured as a through-bore and be sealed subsequently with a corresponding plug/disk.

It must be noted that the designation "bore" chosen in this document is not to be understood exclusively in the sense that the element thus designated is made by "boring." Much rather, the element referred to as "bore" may also have a cross-section deviating from the circular shape.

BRIEF DESCRIPTION OF THE DRAWINGS

The present invention will be further understood and appreciated by reading the following description in conjunction with the accompanying drawings, in which.

DETAILED DESCRIPTION OF THE INVENTION

Figure 3:
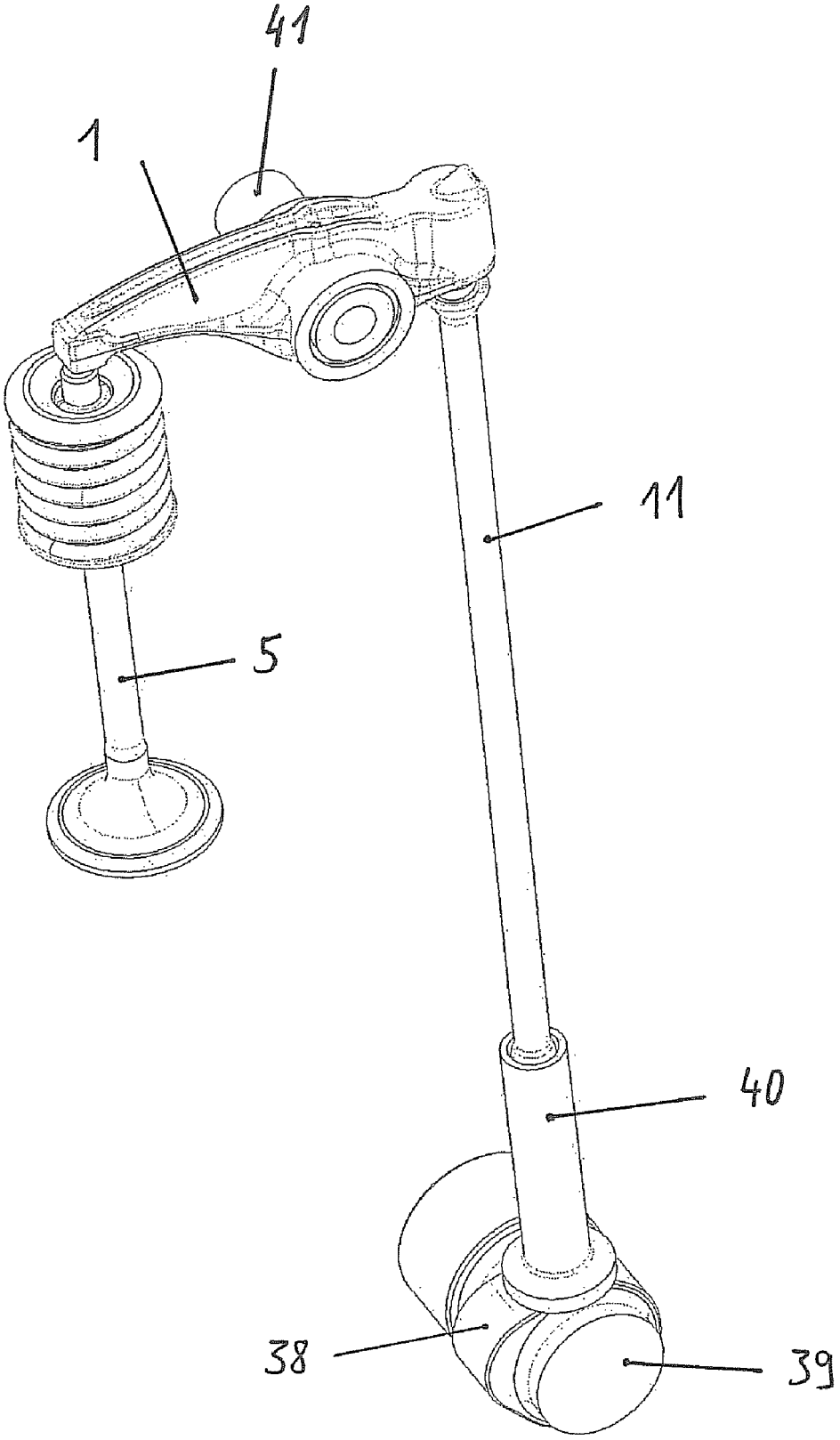
FIG. 3 discloses the rocker arm in the installed position in a valve train.

The drawings show a rocker arm 1 for a tappet pushrod valve train (See, FIG. 3). The rocker arm 1 comprises on an underside 2 on one end 3 a contact surface 4 for a gas exchange valve 5. On another end 6, the rocker arm 1 possesses a bore 7 configured as a pocket hole with a hydraulic lash adjusting element 8 arranged therein. An under surface 9 of the lash adjusting element 8 forms a support 10 for a tappet pushrod 11. The tappet pushrod 11 is loaded by a tappet 40 which is contacted by a cam 38 of a bottom camshaft 39.

Between the ends 3 and 6, the rocker arm 1 comprises a transverse bore 12 for a pivotal mounting on an axle 41. A primary passage 14 for hydraulic medium leads from the transverse bore 12 to a side of the bore 7. A venting passage 15 that is aligned to the primary passage 14 starts from a bottom 16 of the bore 7 and possesses an outlet 18 in the region of the another end 6. (See, FIG. 1).

A secondary passage 19 for a flow of the hydraulic medium carried along in the venting passage 15 branches from the venting passage 15. An opening 20 of the secondary passage 19 extends on an upper side 21 of the rocker arm 1 and is situated in a longitudinal channel 22 for hydraulic medium extending along the upper side 21 of the rocker arm 1 and into a region on the one end 3. The hydraulic medium can be guided from the longitudinal channel 22 via an end passage 23 to the contact surface 4 for lubricating the contact surface 4. As can be readily recognized (See Also, FIG. 2), the longitudinal channel 22 ends near the one end 3, so that the hydraulic medium simply flows over a "smooth" front end of the rocker arm 1 on the one end 3 to the contact surface 4.

The opening 20 of the secondary passage 19 is positioned so that, as seen in gravity direction during a pivoting movement of the rocker arm 1, the opening 20 is situated at a lower level than the outlet 18 of the venting passage 15. In this way, the hydraulic medium flows in a controlled manner into the longitudinal channel 22 on the upper side 21. An outlet 18 of the venting passage 15 and the opening 20 of the secondary passage 19 are situated, each one, in a respective side 35, 36 of a roof-shaped elevation 37 (See, FIG. 2) projecting from the upper side 21 of the rocker arm 1. The aligned elements, venting passage 15 and primary passage 14, are bored-through in a single step starting from the another end 6.

Figure 1:
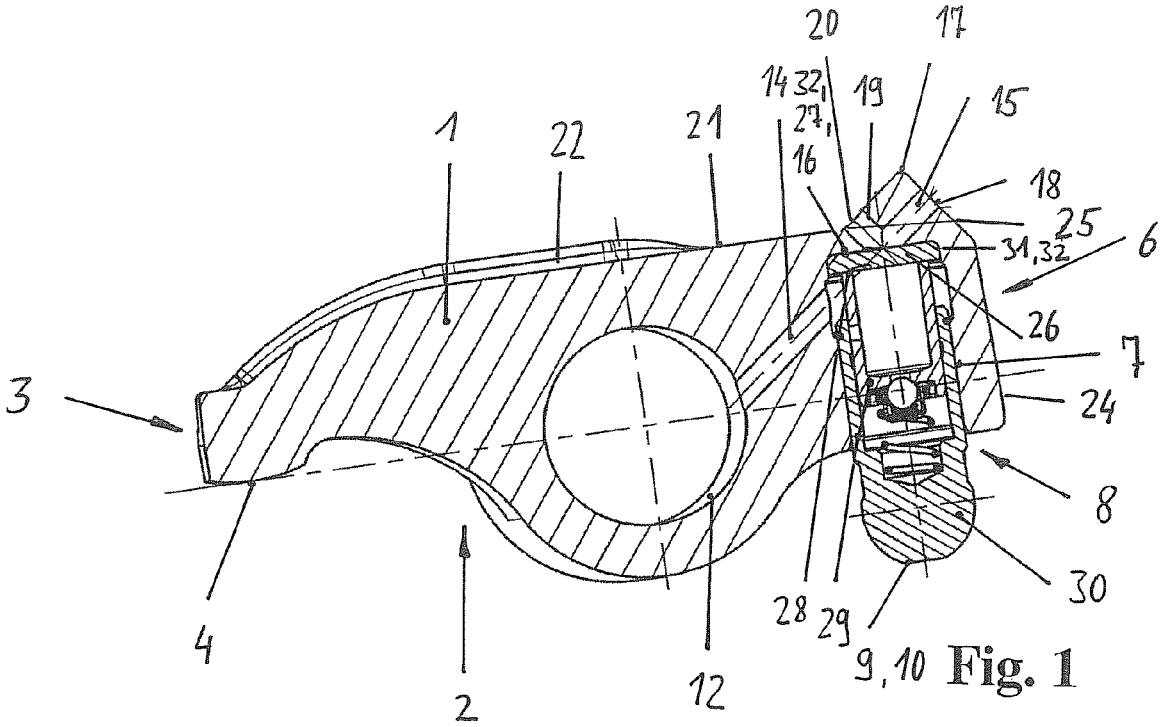
FIG. 1 discloses a longitudinal section through a rocker arm.

FIG. 1 further discloses that a spacing disk 26 bears with an inner side 27 against the bottom 16 of the bore 7 for the lash adjusting element 8, a stationary housing 29 of the lash adjusting element 8 being supported on an outer side 28 of the spacing disk 26. The housing 29 is surrounded by an axially displaceable pressure piston 30 which comprises the support 10 and extends directly in the bore 7. Between an edge 31 of the spacing disk 26 and the bore 7, as also between the inner side 27 of the spacing disk 26 and the bottom 16 of the bore 7, is formed an escape channel 32 with a throttling function for hydraulic medium/air to the secondary passage 19 and the venting passage 15.

Figure 2:
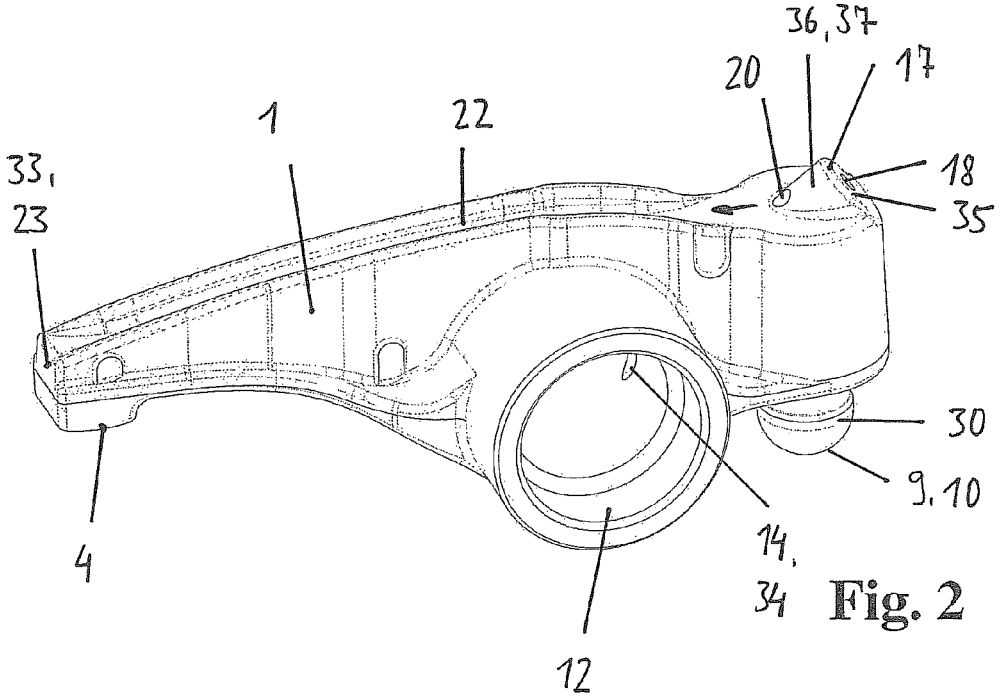
FIG. 2 discloses a three-dimensional top view of the rocker arm of FIG. 1.

It can further be seen in FIG. 2 that a branching region 34 of the primary passage 14 on the transverse bore 12 is configured as a simple opening, so that the transverse bore does not comprise any annular grooves etc. A rotating pick-up of hydraulic medium is thus affected via a continuous annular groove on the axle 41, roughly indicated in FIG. 3, so that the axle can be installed in any directional position.

LIST OF REFERENCE NUMERALS

| | |
|---|---|
| 1 | Rocker Arm |
| 2 | Underside |
| 3 | One End |
| 4 | Contact Surface |
| 5 | Gas Exchange Valve |
| 6 | Another End |
| 7 | Bore |
| 8 | Lash Adjusting Element |
| 9 | Under Surface |
| 10 | Support |
| 11 | Tappet Pushrod |
| 12 | Transverse Bore |
| 13 | Not Used |
| 14 | Primary Passage |
| 15 | Venting Passage |
| 16 | Bottom |
| 17 | Upper Region |
| 18 | Outlet of Venting Passage |
| 19 | Secondary Passage |
| 20 | Opening of Secondary Passage |
| 21 | Upper Side |
| 22 | Longitudinal Channel |
| 23 | End Passage |
| 24 | Front End |
| 25 | Section |
| 26 | Spacing Disk |
| 27 | Inner Side |
| 28 | Outer Side |
| 29 | Housing |
| 30 | Pressure Piston |
| 31 | Edge |
| 32 | Escape Channel |
| 33 | Outer Surface |
| 34 | Branching Region |
| 35 | Side |
| 36 | Side |
| 37 | Elevation |
| 38 | Cam |
| 39 | Camshaft |
| 40 | Tappet |
| 41 | Axle |

The invention claimed is:

1. A rocker arm for a tappet pushrod valve train, comprising:

a longitudinal body having a first end, a second end, an upper surface and a lower surface;

a contact surface for a gas exchange valve formed on the lower surface near the first end;

a first bore formed in the lower surface, adjacent to the second end; a hydraulic lash adjusting element having a support for a tappet pushrod;

a second bore, which allows for pivotal mounting of the rocker arm on an axle, extending transversely between the first end and the second end;

a channel extending substantially along the upper surface to an end passage at the first end;

a primary passage for hydraulic medium extending in the housing between the first bore and the second bore;

a venting passage, which is in line with the primary passage, extending from the first bore to an outlet of the venting passage;

a secondary passage, which branches off from the venting passage, extending outwardly from the first bore to an opening in an upper side, allowing the hydraulic medium to flow along the long channel in the upper body toward the first end of the surface such that the hydraulic medium can be directed from the end passage to the contact surface.

2. The rocker arm according to claim 1, wherein the opening of the secondary passage is positioned so that, as viewed in direction of gravity during a pivoting operation of the rocker arm, the opening is situated at a lower level than the outlet of the venting passage.

3. The rocker arm according to claim 1, wherein the venting passage and the primary passage are both bores that extend from the second end and are oriented at an inclination with respect to the lower surface.

4. The rocker arm according to claim 1, further comprising a spacing disk arranged in the first bore and bearing with an inner side against a bottom of the first bore.

5. The rocker arm according to claim 4, wherein the lash adjustment element has an axially displaceable pressure piston, which includes the support and extends directly into the first bore and the lash adjustment element has a stationary housing, which is supported on an outer side of the spacing disk and is surrounded by the axially displaceable pressure piston.

6. The rocker arm according to claim 4, wherein an escape channel, which has a throttling function for the hydraulic medium or air, is formed between an edge of the spacing disk and the first bore and between the inner side of the spacing disk and the bottom of the bore, and the escape channel extends to the secondary passage and the venting passage.

7. The rocker arm according to claim 1, wherein the end passage extends directly on outer surfaces of the rocker arm at the first end or the end passage is a through-bore which extends from the upper surface to the lower surface in a region of the contact surface.

8. The rocker arm according to claim 1, wherein the first bore is a pocket bore or a through-bore, which is subsequently sealed at the upper surface of the body to form a bottom side for the first bore.

9. The rocker arm according to claim 1, wherein the second bore has smooth walls or walls that are free from annular grooves in a region where the second bore adjoins the primary passage.

10. The rocker arm according to claim 1, wherein a protrusion projects from the upper surface of the body, and the outlet of the venting passage and the opening of the secondary passage are each situated in a side of the protrusion.

* * * * *